US007946347B2

(12) United States Patent
Reid et al.

(10) Patent No.: US 7,946,347 B2
(45) **Date of Patent: *May 24, 2011**

(54) INJECTION VALVE

(75) Inventors: Michael Adam Reid, Aberdeen (GB); Irvine Cardno Brown, Aberdeen (GB)

(73) Assignee: Red Spider Technology Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/380,926

(22) Filed: Mar. 5, 2009

(65) Prior Publication Data

US 2009/0229833 A1 Sep. 17, 2009

Related U.S. Application Data

(63) Continuation of application No. 10/579,325, filed as application No. PCT/GB2004/004890 on Nov. 19, 2004, now Pat. No. 7,520,329.

(30) Foreign Application Priority Data

Nov. 20, 2003 (GB) ..... 0327021.2

(51) Int. Cl.
*E21B 34/08* (2006.01)

(52) U.S. Cl. ..... 166/325; 166/334.1; 166/334.4; 166/373

(58) Field of Classification Search ..... 166/373, 166/321, 334.1, 325, 334.4
See application file for complete search history.

(56) References Cited

U.S. PATENT DOCUMENTS

| | | | | |
|---|---|---|---|---|
| 2,033,563 | A | 3/1936 | Wells | |
| 2,161,309 | A | 6/1939 | O'Donnell | |
| RE22,483 | E | 5/1944 | Burt | |
| 2,698,586 | A | 1/1955 | Elonzo et al. | |
| 3,667,543 | A * | 6/1972 | Dean | 166/125 |
| 4,063,594 | A | 12/1977 | Canterbury | |
| 4,339,001 | A | 7/1982 | Paschal, Jr. | |
| 4,420,044 | A | 12/1983 | Pullin et al. | |
| 4,753,292 | A | 6/1988 | Ringgenberg et al. | |
| 5,462,675 | A * | 10/1995 | Hopkins et al. | 210/767 |
| 5,862,864 | A | 1/1999 | Whiteford | |
| 6,533,037 | B2 | 3/2003 | Eslinger et al. | |
| 7,520,329 | B2 * | 4/2009 | Reid et al. | 166/325 |

(Continued)

OTHER PUBLICATIONS

Description and image of PES SI Retrievable Injection Valve, Halliburton Completion Solutions Catalogue No. H03440, pp. 7-28 to 7-29.

(Continued)

*Primary Examiner* — Giovanna C Wright
(74) *Attorney, Agent, or Firm* — Ladas & Parry LLP

(57) ABSTRACT

A valve for use in a downhole tool The valve has an inlet communicating with the work string from which it is anchored. The inlet provides a flow path of a first cross-sectional area. A sealing assembly comprising a spring biased seal cap moves within an outer tubular body to open and close a number of ports arranged through the body. The ports provide a flow path of a combined cross-sectional area greater than the first cross-sectional area and the valve is arranged such that fluid flow through the inlet moves the seal cap to open the valve and create an unimpeded flow path between the inlet and the ports with negligible pressure drop. An embodiment including a shear ring is described to facilitate pressure testing above. A further embodiment includes a load adjuster to assist in closing the valve. The valve can be a high lift injection valve.

11 Claims, 5 Drawing Sheets

U.S. PATENT DOCUMENTS

2001/0054505 A1 12/2001 Carmody et al.

OTHER PUBLICATIONS

International Search Report mailed Aug. 3, 2005.
Otis Engineering Corporation's 1974-75 Catalog.
Petroline Well Systems Catalog.
Description and Image of Otis Injection Safety Valve, Otis Wireline Subsurface Flow Controls & Related Service Equipment Catalog, 1980, pp. 48 and 49.
Description and Image of Petroline Type C back pressure valve, The Petroline Composite Catalogue, pp. 22-25.

* cited by examiner

INJECTION VALVE

CROSS REFERENCE TO RELATED APPLICATIONS

This application is continuation of U.S. patent application Ser. No. 10/579,325, filed on Oct. 26, 2006, now U.S. Pat. No. 7,520,329, entitled Valve, which is a U.S. national phase, pursuant to 35 U.S.C. §371, of international application No. PCT/GB2004/004890, published in English on Nov. 19, 2004 as international publication No. WO 2005/052313 A1, which claims the benefit of British application Ser. No. GB 0327021.2, filed Nov. 20, 2003, the disclosure of which applications are incorporated herein in their entireties by this reference.

BACKGROUND OF THE INVENTION (1) Field of the Invention

The present invention relates to valves typically used on downhole tools in oil and gas wells and in particular, though not exclusively, to a water injection valve.

(2) Description of Related Art

In secondary recovery of oil and gas wells it is possible to use the technique of water flooding for enhanced oil recovery. This technique relies on injecting water into the reservoir and is normally undertaken using one or more water injection wells. Such valves are typically made up to a wireline lock or retrievable packer and run to depth. A suitable valve design comprises a body including a seat against which a poppet or other closing surface of the valve can rest. The poppet is biased towards the seat(s) to hold the valve in a closed position. Water passed down the tubing string of a well bore will arrive at the poppet, and the water pressure will work against the loading of the spring and force the poppet away from the seat. The water is then directed through ports in the poppet, whereupon it takes a convoluted path to return to a central path through the valve and exit at its base.

Such valves have a number of disadvantages. Typically these valves have a spring which applies a load to the poppet to keep the valve closed. Thus when water flows an initial pressure will open the valve but there is a tendency for the valve to close again as the pressure drops when the fluid is flowing through the valve.

A further disadvantage of these valves is in the arrangement of the ports through which the water flows when the valve is open. By the nature of the design, these ports are typically small in diameter and as such they increase the pressure drop through the valve. The convoluted narrow path also causes erosional problems through the valve and increases the potential debris build up in the valve which can cause the valve to fail.

Some water injection valves are designed as high lift valves. Such valves are designed so that the poppet moves easily to the full open position with the minimum water injection flow rate. Unfortunately such a high lift design results in a low load spring design producing low resultant closing forces on the poppet mechanism. This can lead to problems with debris ingress between the poppet and seat preventing a seal.

SUMMARY OF THE INVENTION

It is an object of at least one embodiment of the present invention to provide a valve which overcomes at least some of the disadvantages of prior art valves.

It is a further object of at least one embodiment of the present invention to provide a water injection valve having a high bypass flow area.

A yet further object of at least one embodiment of the present invention is to provide a water injection valve which is a high lift valve.

According to a first aspect of the present invention there is provided a valve for use in a downhole tool, the valve comprising a substantially tubular body including a first end for connection to a wireline lock or packer, the first end having a first inlet communicating with the string providing a flow path of a first cross-sectional area; one or more ports located on the body, the ports providing a flow path of a combined cross-sectional area greater than the first cross-sectional area; a sealing assembly comprising a seal cap moveable in relation to the body to open and close the ports; wherein fluid flow through the inlet moves the seal cap to open the valve and create an unimpeded flow path between the inlet and the ports with negligible pressure drop.

By creating a direct flow path from the inlet to the outside of the valve through the ports, which is unimpeded, that is the cross-sectional area of the flow path is not reduced, the problems associated with a pressure drop through the valve are alleviated.

Preferably the ports are arranged circumferentially on the tubular body. More preferably the cross-sectional area of the ports is greater than half the total surface area of the tubular body. In a preferred embodiment there are two substantially rectangular ports located on the tubular body. The ports are arranged such that they take up a substantial portion of the tubular body to provide for maximum flow through of fluid when the valve is open. In the preferred embodiment portions of the tubular body between the ports provide longitudinally arranged rails.

Preferably the sealing assembly includes a first sealing surface and the tubular body includes a second sealing surface, the surfaces contacting to close the valve.

Preferably the seal cap is a poppet and the first sealing surface is an outer surface of the poppet located at an end of the sealing assembly. Preferably the second sealing surface is a seat located circumferentially on an inner surface of the tubular body. More preferably the sealing assembly includes biasing means to bias the poppet and the first sealing surface towards the second sealing surface.

Advantageously the biasing means is a spring located centrally within an enclosed bore of the sealing assembly. Preferably a first end of the spring locates at a base of the sealing assembly and an opposing end of the spring locates at a base of the poppet.

Preferably the outer surface of the poppet engages with the rails to maintain linear movement of the poppet within the tubular body.

Preferable the valve includes pressure release means to open the valve at a predetermined fluid pressure. Preferably the pressure release means comprises shearing means which prevents movement of the poppet on the sealing assembly. Preferably also the second sealing surface is located on a floating component. In this way seal is maintained between the surfaces until the shearing means is sheared. Advantageously the shearing means is a shear ring.

Optionally a load adjuster is located between the biasing means and the first surface to vary the load applied by the first surface upon the second surface. In a typical valve, as the first surface approaches the second surface to move the valve to the closed position, the load from the biasing means is at its lowest and the potential for debris build-up between the surfaces is at its highest. By incorporating a load adjuster, the load can be increased as the valve is closed, to pull the valve to the fully closed position. This increases the surface to surface contact load and resulting sealing performance of the valve, particularly where the valve is used as a high lift valve.

Preferably the load adjuster comprises a sprung collet. The sprung collet may comprise an engaging portion having sprung cantilevers extending therefrom. The engaging portion may be considered as a dog. Preferably the collet is arranged in parallel to a central longitudinal axis of the valve.

Preferably the load adjuster further includes at least one roller. Preferably at least one roller is mounted on the engaging portion or dog.

Preferably the roller is located against a running surface of the valve wherein the running surface is substantially parallel to the central axis. More preferably the running surface comprises three sloping sections, a first sloping section being at a first angle to the running surface, a third sloping surface being at a second angle to the running surface and an apex of the first sloping surface being connected to the base of the third surface to provide the second sloping surface.

In an embodiment of the present invention the first and third sloping surfaces are angled at approximately ninety degrees to the running surface. In an alternative embodiment of the present invention the first and third sloping surfaces are at a steep angle to the running surface.

More preferably the load adjuster is arranged on an inner surface of the poppet and the running surface is arranged on an outer surface of the second tubular body. In this way biasing of the spring causes movement of the load adjuster along the outer surface of the second tubular body. In an embodiment, the sprung collet ensures that the roller is located against a sloping surface of the running surface when the tool is assembled.

Preferably the valve is an injection valve. The valve may be a water or gas injection valve. Alternatively the valve is a check valve as would be used in a downhole safety device.

According to a second aspect of the present invention there is provided a method of injecting fluid into a well bore, the method comprising the steps:

(a) locating an injection valve on an anchoring device at an end of a work string;
(b) running the string to a required depth;
(c) sealing the string to a wall of the well bore using the anchoring device;
(d) passing fluid at a first pressure through the work string; and
(e) using the fluid to open the valve and thereby inject fluid through an unimpeded path through the valve into the well bore while maintaining fluid pressure at the first pressure.

Preferably the injection valve is according to the first aspect. The method may include the step of trapping pressure below the valve. This method makes the well safe on closure of the valve or if a sudden pressure increase is experienced below the valve.

More preferably the injection valve incorporates the pressure release means and the method further includes the step of performing one or more pressure tests above the valve.

While the terms 'up', 'down', 'top' and 'bottom' are used within the specification, they should be considered as no more than relative, as the valve of the present invention may be used in any orientation.

BRIEF DESCRIPTION OF THE DRAWINGS

Embodiments of the invention will now be described, by way of example only, with reference to the accompanying figures in which:

FIG. 1(*b*) is a part cut-away cross-sectional view through a valve according to an embodiment of the present invention, shown in a closed configuration;

DETAILED DESCRIPTION OF PREFERRED EMBODIMENTS

Figure 1A:
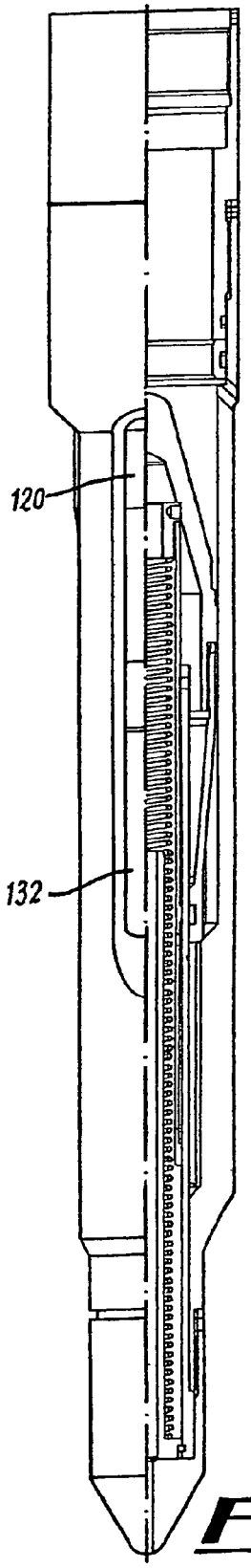
FIG. 1(*a*) is a part cut-away cross-sectional view through a valve according to an embodiment of the present invention, shown in an open configuration.
Figure 1B:
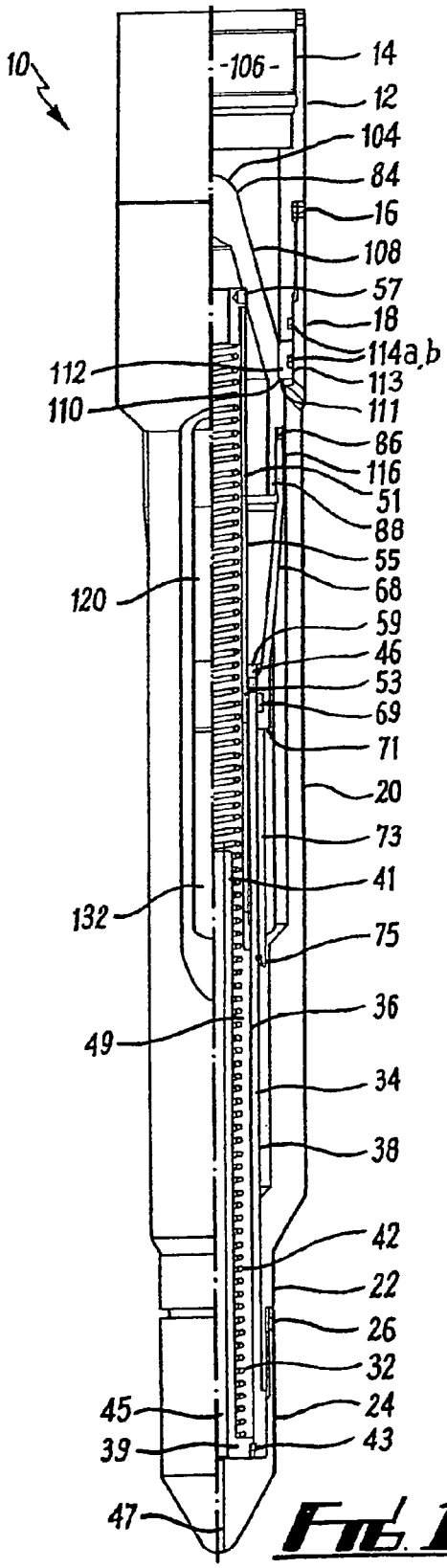

Referring initially to FIG. 1 of the drawings there is illustrated a valve, generally indicated by reference numeral 10, according to a first embodiment of the present invention. FIG. 1(*a*) is the valve 10 in an open configuration, while FIG. 1(*b*) is the valve 10 in a closed configuration. To those skilled in the art, valve 10 is recognisable as a water injection valve but could equally be adapted to a check valve or other arrangement as would be found on a downhole tool for controlling fluid flow.

Valve 10 comprises a top sub 12 including a box section 14 for connecting the valve 10 to an anchoring device i.e. a lock or packer. Typically the valve is made up to an wireline lock or retrievable bridge plug and run to depth, usually in the packer tail pipe. Top sub 12 contains a bore 106. Bore 106 is the inlet to the valve 10 so that fluid passed down the work string can input the valve. Bore 106 has a circular cross-section and at its narrowest diameter provides a flow path cross-sectional area at the inlet.

Threaded to the top sub 12 is a flow housing 18 held in place by set screws 16. The design of flow housing 18 is advantageous to the operation of the injection valve and will be described hereinafter with reference to FIG. 2. The housing 18 is primarily a tubular body providing an outer surface 20 to the valve 10. At a lower end 22 of the housing 18 is attached a bottom sub or end cap 24. End cap 24 is threaded to the housing 18 and prevented from detachment by means of set screws 26.

End cap 24 includes a bore 32 into which is located a inner tube 34. Inner tube 34 provides a tubular body having an inner cylindrical surface 36 and an outer surface 38. Mounted within the inner cylindrical surface 36 and located around an inner tubular centraliser 39 a spring 42. Spring 42 extends beyond the upper end 46 of the inner tube 34 and the upper end 41 of the centraliser 39.

Centraliser 39 abuts the end of the bore 32 in the bottom sub 24. Centraliser 39 abuts the end cap 24. For assembly, a snap ring 43 is located between the centraliser 39 and the tube 34. Centraliser 39 also includes an axial bore 45 which aligns with an exit bore 47 through the end cap 24. These bores 45,47 provide fluid access in a chamber 49 in which the spring 42 is located.

The upper end of spring 42 is bounded by an upper spring housing 51. Housing 51 comprises a cylindrical sleeve 55 having a lip 53 on the outer surface at a lower end thereof. The sleeve 55 is threaded to a cap 57 at the upper end of the spring 42. Inner tube 34 includes a lip 59 on an inner surface at the top 46. Lips 53,59 engage to prevent longitudinal movement to separate the housing 51 from the tube 34.

Located on the cap 57 is a poppet 84 providing a rounded nose cone 104 which locates in the bore 106 on the top sub 12. Poppet 84 further provides a frusto-conical surface 108 which includes a ledge 110 which provides a sealing surface 111 to seal against a poppet seat 112 located on the flow housing 18. Poppet seat 112 provides a further sealing surface 113 which when it meets the surface 112 seals the bore 106 to prevent fluid flow which enters the bore 106 from exiting the valve 10. This configuration can therefore be considered as a closed configuration of the valve 10. Appropriate O-rings 114*a* and 114*b* are located between the poppet seat 112 and the inner surface 116 of the flow housing 18, and between the top sub 12 and the flow housing 18, respectively. This prevents the ingress of fluid through the valve 10.

The ledge 110 and thus the poppet 84 is held against the poppet seat 112 by the spring 42 and the surfaces 111,113 seal together. This closed position is shown on the FIG. 1(*b*) wherein the poppet 84 is seated on the poppet seat 112 and there is no flow through the valve.

Threaded and held by set screws 86 to a recess 88 on an outer surface 90 of the poppet 84, is a poppet skirt 68. The skirt 68 provides a streamlined profile running back to the inner tube 34. Skirt 68 is sized to fit around the inner tube 34 and a wiper ring 69 is located therebetween. The ring 69 allows the poppet 84 to move longitudinally relative to the tube 34 and housing 18. Attached to a lower end 71 of the skirt 68 is a shear ring housing 73 which abuts a shear ring 75 located on the outer surface 38 of the tube 34.

In this way, the poppet 84 is held in a sealed position until sufficient force is applied to shear the shear ring 75. On shearing the parts of the ring 75 are held within the shear ring housing 73. This means that the parts cannot come away from the valve and cause the valve to malfunction or have part of the shear ring 75 left downhole to cause damage to other equipment.

By including the shear ring 75, the poppet 84 can hold pressure from above and below the valve in the closed configuration. To allow the poppet 84 to hold pressure from above the poppet seat 112 has 'float' built in i.e. the top sub 12 and the housing 18 provide a recess at the seat 112 longer than the length of the seat 112 so that it can travel longitudinally between defined limits. This float allows the poppet 84 and the seat 112 to move down together as fluid is applied from above. The float also addresses any tolerance issues and gives enough stroke to ensure the shear ring 75 is sheared properly before the poppet seat 112 bottoms out and the poppet 84 comes off seat allowing fluid to pass through the passage 120.

Selection of the pressure rating of the shear ring, provides a value at which pressure can be tested above the valve in the closed configuration. Any number of tests can be performed as long as the overall pressure in the bore 106 is not allowed to exceed the rating of the shear ring 75. The pressure is then exceeded to shear the ring 75 and allow fluid to be injected through the valve 10.

On opening, fluid pressure acts on the poppet 84 and it is forced downwards against the spring 42. While pressure is maintained fluid flows freely and directly from the bore 106 to the ports 132 on the housing 18. Due to the cross-sectional area of the flow path 120 through the ports 132, greatly exceeding the input flow path cross-sectional area at the bore 106, there is negligible pressure drop as the valve 10 is opened. The pressure will thus remain substantially constant through the valve as it is opened and in use. The opened configuration is shown in FIG. 1(*a*).

The profile of the nose 104 together with the skirt 68 provides a streamlined flow passage 120 to maximise fluid flow through the valve in the open position. This is further enhanced by the design of the flow housing 18 located around the inner tube 34. This is seen with the aid of FIG. 2.

Figure 2A:
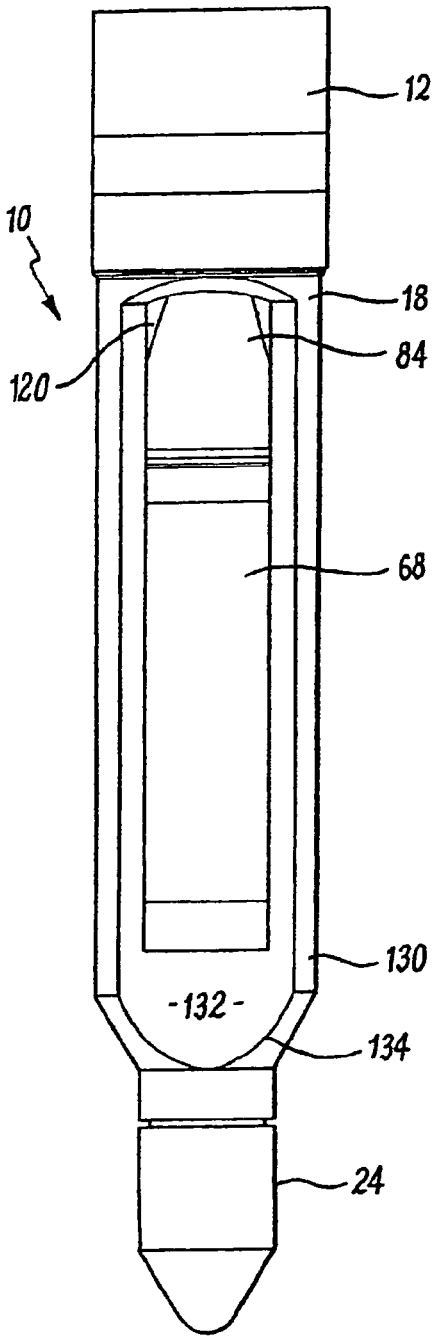
FIGS. 2(*a*) and 2(*b*) illustrate schematic views of the arrangement of the flow housing on the valve of FIG. 1(*a*) and/or 1(*b*) wherein FIG. 2(*a*) is rotated by ninety degrees with respect to FIG. 2(*b*)
Figure 2B:
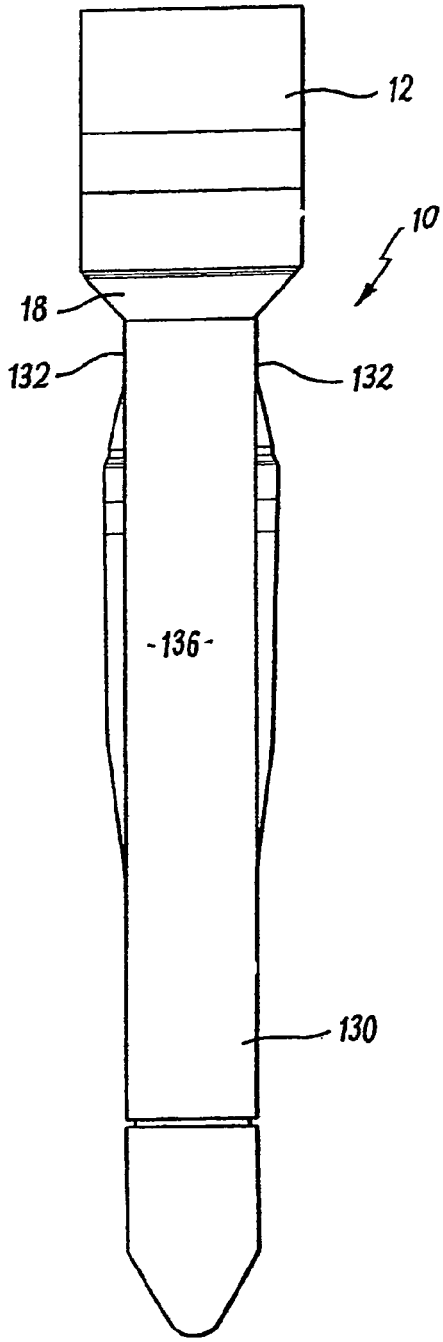

FIG. 2(*a*) provides a side view of the housing 18, while FIG. 2(*b*) shows the same housing rotated by 90 degrees. Flow housing 18 comprises a tubular body 130 which has a diameter less than or equal to the diameter of the top sub 12. Oppositely arranged on the body 130 are two slots or ports 132. Ports 132 are arranged longitudinally and cover a substantial portion of the valve 10, beginning at the top sub 12 and ending near the end cap 24. Ports 132 are substantially rectangular in cross-section having a rounded portion 134 toward the end cap 24. The ports 134 may be of any chosen dimensions but must provide a cross-sectional area that is greater than the cross-sectional area of the bore 106. Preferably the cross-sectional area of the ports is approximately an order of magnitude greater than the cross-sectional area of the bore 106. The shape in this embodiment is as a consequence of milling through a cylinder formed on a slope. Together the ports 132 remove a substantial portion of the body 130 to provide maximum flow of fluid through the valve 10. Portions of the body 30 remaining to either side of the ports 132 provide rails 136 used to help guide the poppet 84 through the valve without impeding its path. Thus as can be seen from FIG. 2(*a*) that the poppet 84 and poppet skirt 68 are substantially exposed within the body 130.

This cut-away to flow housing 18 results in the valve 10 having a high bypass flow area which minimises the pressure drop and erosion problems through the valve 10. This additionally reduces the debris build up potential as there are less surfaces, ledges or other surface areas which the flow path impinges on where debris could collect.

In an alternative embodiment, the areas of the valve 10 which are exposed to the injection flow rates such as the nose cone 104 and surfaces of the flow housing 18, may be coated with a tungsten carbide based coating. The coating is directed to areas where the direction of flow changes in particular. The coating is included to help protect the valve sealing surfaces from the effects of erosional flow particularly when large amounts of debris are anticipated. Such coatings are known to those skilled in the art of downhole ball valve technology.

In an alternative embodiment of the present invention, the poppet seat 112 is made reversible which will help reduce valve redress costs. In a yet further embodiment, the poppet seat is provided as a soft seal. This embodiment is thus particularly suitable for applications where water and gas are injected alternately through the valve and the soft seal improves the gas sealing characteristics of the valve.

Figure 3:
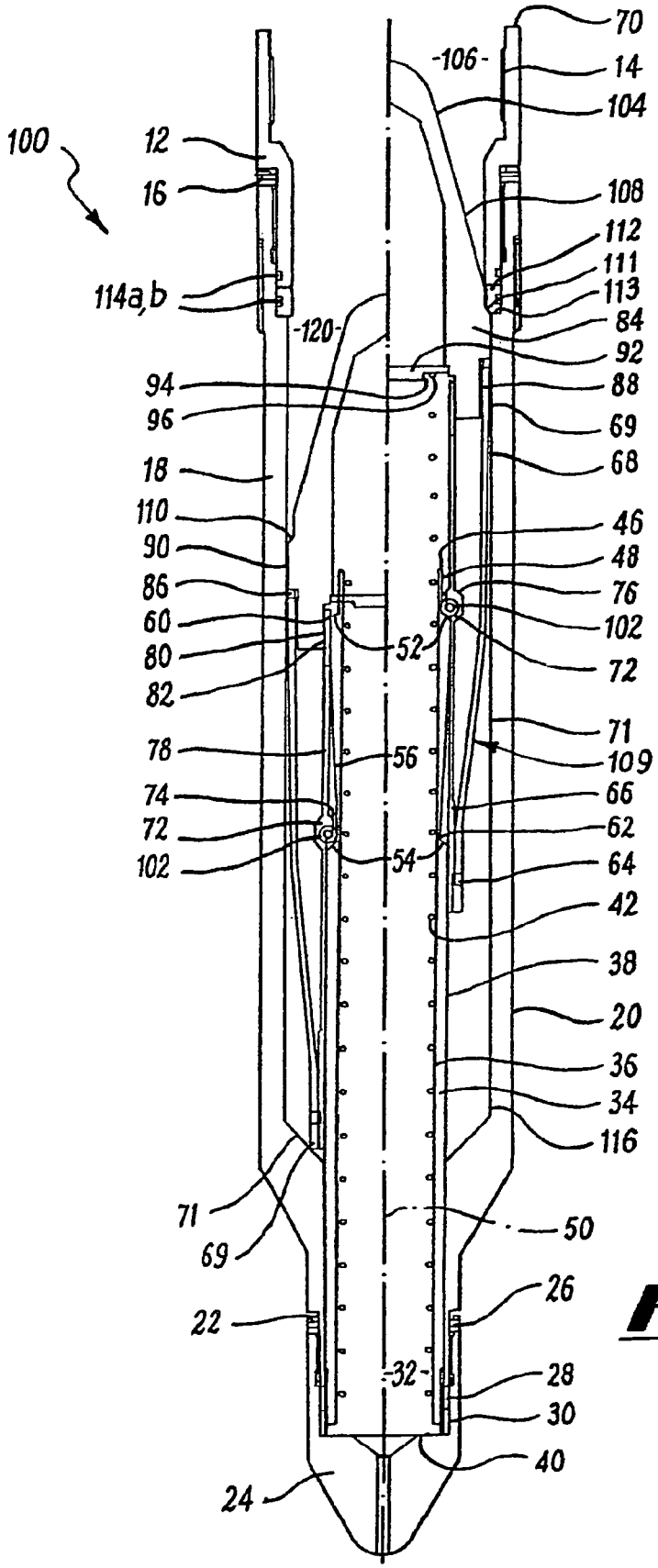
FIG. 3 is a cross-sectional view of a valve according to a further embodiment, wherein the left hand side of the figure illustrates the valve in the open configuration and the right hand side illustrates the valve in the closed configuration.

Reference is now made to FIG. 3 of the drawings which illustrates a valve, generally indicated by reference numeral 100, according to a second embodiment of the present invention. Like parts to those of the valve 10 have been given the same reference numeral. FIG. 3 illustrates the valve 100 in closed (right hand side) and open (left hand side) configurations. To those skilled in the art, valve 100 is recognisable as a water injection valve but could equally be adapted to a check valve or other arrangement as would be found on a downhole tool for controlling fluid flow.

Valve 100 comprises a top sub 12 including a box section 14 for connecting the valve 100 to an anchoring device i.e. a lock or bridge plug. Typically the valve is made up to an wireline lock or retrievable bridge plug and run to depth, usually in the packer tail pipe. Threaded to the top sub 12 is a flow housing 18. The housing 18 is primarily a tubular body providing an outer surface 20 to the valve 100. At a lower end 22 of the housing 18 is attached a bottom sub or end cap 24. End cap 24 is threaded to the housing 18 and prevented from detachment by means of set screws 26. There is also located an adjustment nut 28 and an adjacent lock nut 30 so that the relative positioning between end cap 24 and the housing 18 can be set.

End cap 24 includes a bore 32 into which is located a inner tube 34. Inner tube 34 provides a tubular body having an inner cylindrical surface 36 and an outer surface 38. Mounted within the inner cylindrical surface and abutting a base 40 of the bore 32 is a spring 42. Spring 42 extends beyond the upper end 46 of the inner tube 34.

From the end 46, the outer surface 38 provides a substantially longitudinal portion 48, running in parallel to the spring 42 which is aligned on a central axis 50 of the valve 100. Portion 48 meets a face 52 which rises outwardly from the surface 38 at an angle of approximately seventy-five degrees. This provides an acute ramp on the outer surface 38. Thereafter the outer surface provides a gentle ramp 56 toward a second face 54 which provides a second acute face as that of the face 52. Between each face 52,54 the outer surface 38 the gentle ramp 56 extends from the apex 60 of the face 52 to the base 62 of the face 54. This ramp 56 is directed toward the central axis 50 as it travels toward the end cap 24.

Located below the face 54 are the end portions of a first collet spring 66 and a poppet skirt 68. The collet spring 66 and the poppet skirt 68 are threaded together and locked by set screws 64. The collet spring 66 and the poppet skirt 68 can slide on the outer surface 38 of the inner tube 34.

Collet spring 66 extends toward the upper end 70 of the valve 100 providing a cantilevered release spring terminating at a dog 72. Dog 72 is a typical dog providing inner 74 and outer 76 raised portions. Although only one dog 72 is illustrated, it will be appreciated that any number can be arranged around the inner tube 34 Dog 72 is connected to a further collet spring 78 whose end 80 extends toward the upper end 70 of the valve 100. The collection of collet spring 78, dog 72 and collet spring 66 'fingers' provide a collet generally indicated by reference numeral 109.

Typically, the collet 109 is formed by turning a profile onto a cylinder and then milling parallel slots through the cylinder axially within its length. The amount of parallel slots arranged around the circumference equals the number of fingers (collet spring 78, dog 72 and collet spring 66). The fingers act like a beam supported at each end. End 80 of collet 109 is cylindrical and supported within a corresponding cylindrical inner surface 82 of a poppet 84.

The poppet skirt 68 is threaded and held by set screws 86 to a recess 88 on an outer surface 90 of the poppet 84. Located above the collet spring 78 on the poppet 84 is a spring washer 92. Spring washer 92 includes an inner lip 94 arranged to face the end cap 24 and retain a top end 96 of the spring 42.

Mounted upon the dog 72 is a wheel 102 arranged so that it can ride upon the outer surface 38 of the inner tube 34. Indeed the wheel 102 may locate on the face 52, run along the ramp 56 towards face 54 as described hereinafter with reference to FIG. 4. An end 69 of the skirt 68 meets an inner surface 71 of the flow housing 18. Spring 42 is thus contained between a base 40 of the end cap 24 and the lip 94 of the spring washer 92 and its movement is controlled by the movement of the collet 109 in relation to the outer surface 38 of the inner tube 34.

The poppet 84 provides a rounded nose cone 104 which locates in a bore 106 on the top sub 12. Poppet 84 further provides a frusto-conical surface 108 which includes a ledge 110 which provides a sealing surface 111 to seal against a poppet seat 112 located on the flow housing 18. Poppet seat 112 provides a further sealing surface 113 which when it meets the surface 112 seals the bore 106 to prevent fluid flow which enters the bore 106 from exiting the valve 100. This configuration can therefore be considered as a closed configuration of the valve 100. Appropriate O-rings 114*a* and 114*b* are located between the poppet seat 112 and the inner surface 116 of the flow housing 18, and between the top sub 12 and the flow housing 18, respectively. This prevents the ingress of fluid through the valve 100.

The ledge 110 and thus the poppet 84 is held against the poppet seat 112 initially by the spring 42 and further by the collet 109 when the dog 72 is located at the face 52 and the wheel 102 abuts the face 52.

Figure 4A:
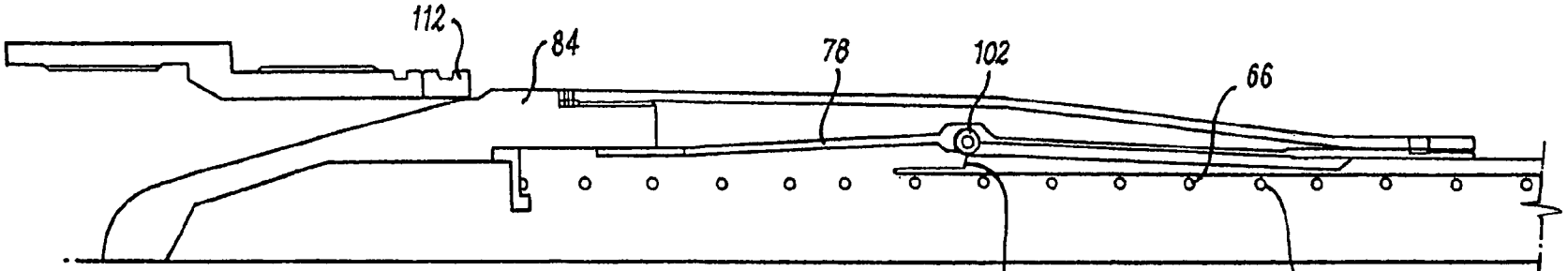
FIGS. 4(*a*) and (*b*) are schematic illustrations of the position of the poppet seat and poppet when the valve of FIG. 3 is moved to the closed position.
Figure 4B:
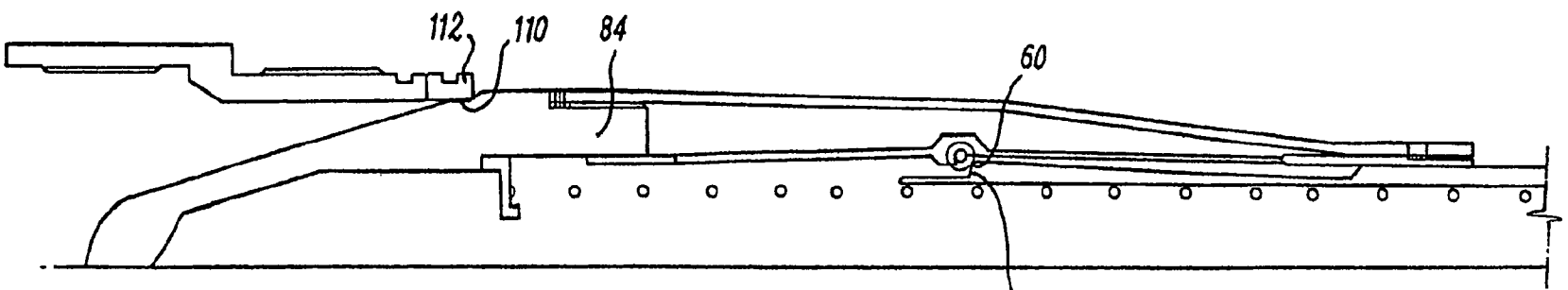

This closed position is further illustrated with the aid of FIG. 4. In FIG. 4(*a*) the wheel 102 is located at the apex 60 of the face 52. At this position the poppet seat 112 and the poppet 84 are close to touching. This is the location that a typical water injection valve of the prior art would find its spring load at its lowest and the potential for debris problems are at their highest. At this position the collet 109 and in particular the collet springs 66, 78 take over from the spring 42 and drive the poppet 84 to the fully seated position against the poppet seat 112. As this occurs the wheel 102 runs down the acute face 52 and locates there against. The poppet seat 112 is now located within the ledge 110 of the poppet 84 and the surfaces 111, 113 seal together.

In this position the collet 109 preloads the poppet 84 against the poppet seat 112. Thus the collet 109 has pulled the valve to the fully closed position. This increases poppet 84 to seat 112 contact load and enhances the resultant sealing performance of the valve. This closed position is shown on the right hand side of FIG. 3 wherein the poppet 84 is seated on the poppet seat 112 and there is no flow through the valve. In order to initiate flow through the valve, water or other fluid is passed through the bore 106. Water causes a pressure on the nose 104 of the poppet 84 and pushes it towards the end cap 24.

Opening of the valve occurs as poppet 84 moves downwards as shown on the left hand side of FIG. 3. As it moves downwards a flow passage 120 is uncovered through the housing 18. On depression of the poppet 84, the wheel 102 is caused to ride up the face 52. The seal between the surfaces 111,113 is broken. Due to the close fit between the ledge 110 and the seat 112, the load due to the, now leaking, pressure will be sufficient to allow the wheel 102 to reach the apex 60. Once over the apex 60 the wheel runs rapidly down the ramp 56 towards the face 54. An end 69 of the poppet skirt 68 meets an inner surface 71 of the flow housing 18. Once the dog 72 has been pushed out of the groove provided by face 52 on valve opening, the drag friction from the collet 109 has been minimised so this does not detract from the spring 42 return load.

Thus when the valve is opened, the valve operates as a high lift valve. This means the poppet 84 moves easily to the full open position with minimal water injection flow rate. Use of the high lift design minimises potential for debris build up above the valve at the location of the seat 112 in the top sub 12.

Returning to FIG. 3, there is illustrated a poppet skirt 68. Poppet skirt 68 is threaded to the recess 88 on the poppet 84. The skirt 68 provides a streamlined profile running back to the threads 64 which attach it to the collet 109. Such a profile of the nose 104 together with the skirt 68 provides a streamlined flow passage 120 to maximise fluid flow through the valve in the open position. This is further enhanced by the design of the flow housing 18 located around the inner tube 34. This housing 18 is illustrated in FIG. 2 and is described hereinbefore with reference to the Figure. In this way the relationship between the cross-sectional area of the flow path at the bore 106 is smaller than the cross-sectional area through the ports 132 as they are opened.

This cut-away to flow housing 18 results in the valve 100 having a high bypass flow area which negligible pressure drop and minimises erosion problems through the valve 100. This additionally reduces the debris build up potential.

It is also noted that the collet 109 is located within a "dead area" of the valve 100 where fluid flow is not experienced and this minimises the effects to the flow and keeps it away from any debris passing through the valve 100.

In use, valve 100 is run into a well bore typically made up to a wireline lock or a retrievable bridge plug, and run to depth in the closed configuration. Once in position, fluid to be injected through the valve 100 is introduced to the bore 1006 at a suitable pressure. Fluid pressure exerted on the nose 104 of the poppet 84 acts against the spring 42. The poppet 84 is thus moved from sealing engagement with poppet seat 112 in a downwards relative direction. On opening, the wheel 102 of the collet 100 rides up the face 52 of the surface 38 and then runs down the ramp 56 towards face 54. An end 69 of the skirt 68 meets an inner surface 71 of the flow housing 18. The valve is now open. Flow rate through the valve is through bore 106 into flow ports 120 exiting through the ports 132 within the flow housing 18.

When the valve is to be closed, water pressure is reduced in the bore 106. Load from the spring 42 acts against the poppet 84 to move it back toward the poppet seat 112. Movement is effected relatively easily as the wheel 102 of the collet 109 moves up the ramp 56. When the wheel 102 reaches the apex 60 of the face 52 the collet springs 66, 78 take over from the spring 42 and drive the poppet 84 into the seated position against the poppet seat 112. Surfaces 111 and 113 abut to form a seal. In the fully seated position collet 109 preloads the poppet 84 as the wheel 102 is now located against the face 52.

Figure 5:
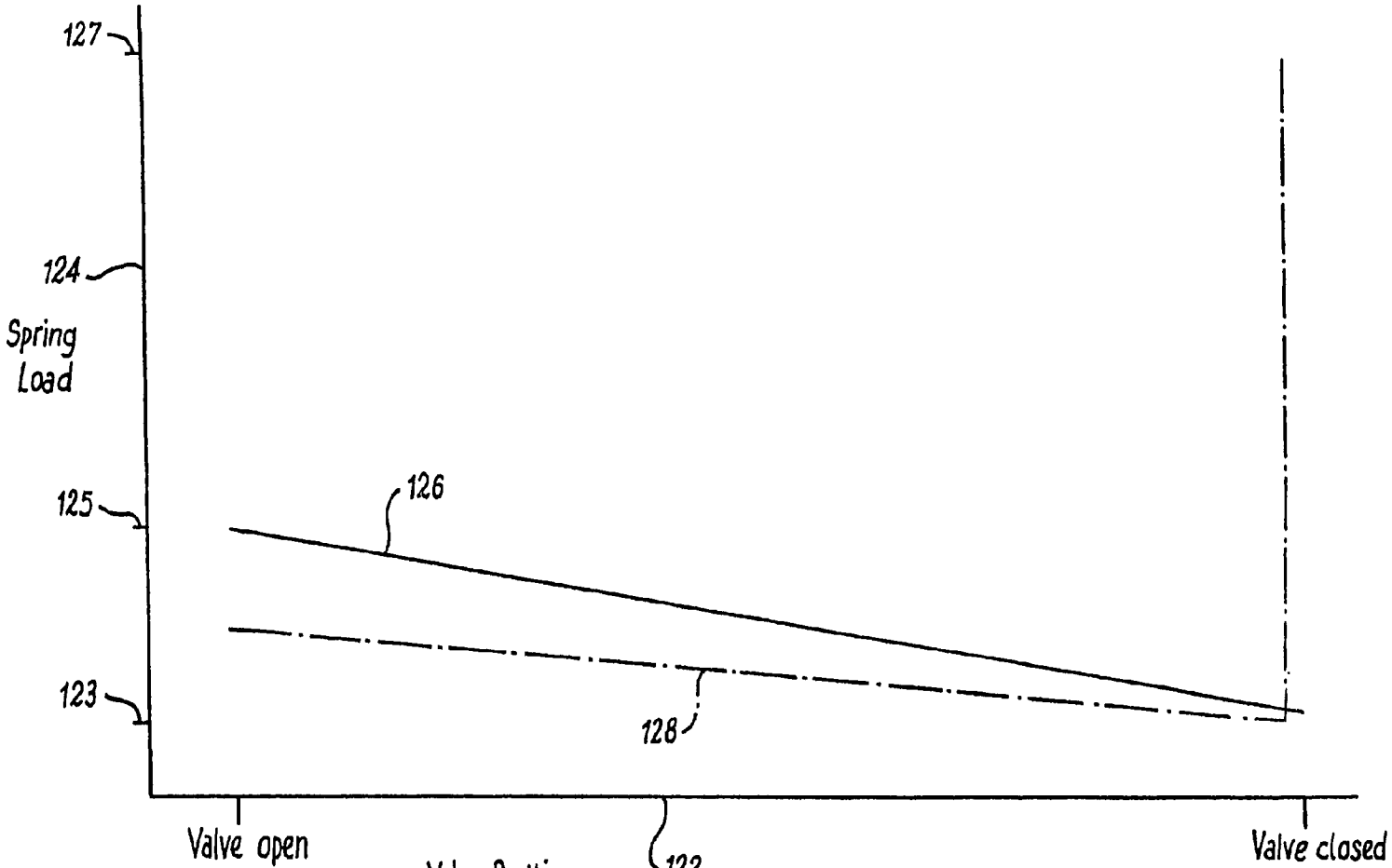
FIG. 5 is a plot of valve closing characteristics comparing the spring load on a traditional injection valve against that of the injection valve of FIG. 3.

Reference is now made to FIG. 5 of the drawings which is a plot of valve position 122 between the open and closed configuration against spring load on the poppet 84. Two graphs are provided. The first 126 shows a typical injection valve load characteristic for prior art injection valves. In this configuration it is seen that the load follows a straight line from a high spring load 125 when the valve is fully open, down to a lower value 123 when the valve is closed. This is a linear relationship. Line 128 illustrates the valve load characteristics of a valve according to at least one embodiment of the present invention. The initial gradient is shallower than the prior art valve and may be considered to approximate to a near constant load. This is due to the weaker start required of the valve and the gradient doesn't increase since the valve is designed with a single large coiled spring. Line 128 follows this linear downward path until just before the valve is closed at position 130. As the valve is closed an additional load is generated by the collet springs 66, 78 and as a result the graph rises sharply to a value 127 which may be considerably larger than the value of the spring load of the traditional valve in the closed configuration.

The principle advantage of the present invention is that it provides a valve having a high bypass flow area with a smooth flow path which minimises pressure drop and erosion problems through the valve while also reducing debris build-up potential in the valve. Production flow is thus optimised and is only restricted by the bore of the anchoring device.

A further advantage of an embodiment of the present invention is that it provides an injection valve which by the inclusion of a shear ring provides a barrier to pressure from both above and below so that pressure testing can be performed.

A further advantage of an embodiment of the present invention is that it provides a valve for a downhole tool in which the load upon the poppet can be maximised when the valve is closed and the poppet is seated against the poppet seat.

It will be appreciated by those skilled in the art that modifications may be made to the invention herein described without departing from the scope thereof. Additionally though a poppet is shown, any suitable arrangement of two sealing surfaces could be used. Yet further the size and number of ports in the flow housing may be changed to vary the flow rate through the valve, while maintaining the desired relationship between the cross-sectional areas. Additionally the skirt may be provided with downward facing ridges such that it provides a streamlined profile to water passage from above and ledges against which water from below can impact, to assist in returning the poppet to the closed position.

The invention claimed is:

1. A valve for use in a downhole tool, the valve comprising a substantially tubular body including a first end for connection to a wireline lock or packer and a second end comprising an end cap, the first end having a first inlet communicating with a string in the well bore and providing a flow path of a first cross-sectional area; one or more ports located on the body wherein the one or more ports are longitudinal slots extending from the first end of the tubular body towards the end cap, the ports providing a flow path of a combined cross-sectional area greater than the first cross-sectional area; a sealing assembly comprising a seal cap moveable in relation to the body to open and close the ports; wherein fluid flow through the inlet moves the seal cap to open the valve and create an unimpeded flow path between the inlet and the ports with negligible pressure drop.

2. A valve as claimed in claim 1 wherein the combined cross-sectional area of the ports is greater than half the surface area of the tubular body at the ports.

3. A valve as claimed in claim 1 wherein the seal cap is a poppet having a first sealing surface and a second sealing surface is a seat located on an inner surface of the tubular body such that when the surfaces contact they form a seal to close the valve.

4. A valve as claimed in claim 3 wherein the sealing assembly includes biasing means to bias the poppet and the first sealing surface toward the second sealing surface.

5. A valve as claimed in claim 4 wherein the biasing means is a spring, the spring enclosed within a housing.

6. A valve as claimed in claim 1 wherein the valve includes pressure release means to open the valve at a predetermined fluid pressure.

7. A valve as claimed in claim 6 wherein the pressure release means is a shear ring which is rated to shear at the desired pressure.

8. A valve as claimed in claim 1 wherein the valve is a high lift injection valve.

9. A method of injecting fluid into a well bore, the method comprising the steps:

(a) locating an injection valve on an anchoring device at an end of a wireline;

(b) running the wireline to a required depth;

(c) sealing the anchoring device to a wall of a string in the well bore;

(d) passing fluid at a first pressure through the string; and (e) using the fluid to open the valve and thereby inject fluid through an unimpeded path through the valve into the well bore while maintaining fluid pressure at the first pressure;

wherein the injection valve is according to any one of claims 1 to 7 or claim 8.

10. A method as claimed in claim 9 wherein the method includes the step of trapping pressure below the valve.

11. A method as claimed in claim 9 wherein the method includes the step of performing one or more pressure tests above the valve.

* * * * *